US010546702B2

(12) United States Patent
Sun

(10) Patent No.: US 10,546,702 B2
(45) Date of Patent: Jan. 28, 2020

(54) KEY STRUCTURE WITH DISPLAY MODULE

(71) Applicant: Jen-Wen Sun, New Taipei (TW)

(72) Inventor: Jen-Wen Sun, New Taipei (TW)

( * ) Notice: Subject to any disclaimer, the term of this patent is extended or adjusted under 35 U.S.C. 154(b) by 0 days.

(21) Appl. No.: 15/971,928

(22) Filed: May 4, 2018

(65) Prior Publication Data

US 2019/0341204 A1 Nov. 7, 2019

(51) Int. Cl.
*H01H 13/10* (2006.01)
*H01H 13/02* (2006.01)

(52) U.S. Cl.
CPC ..... *H01H 13/023* (2013.01); *H01H 13/10* (2013.01); *H01H 2219/036* (2013.01)

(58) Field of Classification Search
CPC ..... H01H 13/023; H01H 9/181; H01H 13/14; H01H 2219/012; H01H 2221/058; H01H 13/04; H01H 13/10; H01H 13/83; H01H 2009/164; H01H 2207/004; H01H 2207/04; H01H 2219/002; H01H 2219/014; H01H 2219/016; H01H 2219/037; H01H 2219/056; H01H 2219/06; H01H 2219/062; H01H 2219/0622; H01H 2221/06; H01H 2227/002; H01H 2239/004; H01R 13/2421; H01R 12/714; H01R 2201/20; H01R 12/57; H01R 12/716; H01R 13/17
See application file for complete search history.

(56) References Cited

U.S. PATENT DOCUMENTS

2009/0107817 A1* 4/2009 Onuki ..... H01H 13/023 200/314
2009/0305580 A1* 12/2009 An ..... H04M 1/0249 439/824
2012/0061227 A1* 3/2012 Chu ..... H01H 13/023 200/520
2012/0061228 A1* 3/2012 Chu ..... H01H 9/181 200/520
2013/0026017 A1* 1/2013 Verd Martinez ..... H01H 9/161 200/307
2013/0288081 A1* 10/2013 Cheng ..... H01M 2/204 429/7
2014/0124343 A1* 5/2014 Lee ..... H04M 1/026 200/302.2
2015/0325939 A1* 11/2015 Kim ..... B23K 33/002 439/700

* cited by examiner

*Primary Examiner* — Ahmed M Saeed
(74) *Attorney, Agent, or Firm* — Che-Yang Chen; Law Offices of Scott Warmuth

(57) ABSTRACT

The present invention provides a key structure with display module, mainly consisting of a press cover, a display module, a base plate, a control switch, and flexible terminals. The display module is electrically connected to a circuit structure and installed in a holding space. The base plate is installed to the press cover and restricts the display module, and is also fixed to the circuit structure inside the holding space. The control switch is electrically connected to a circuit board and fixed to the base plate, and the flexible terminals provide for an electrical connection between the circuit structure and the circuit board.

11 Claims, 8 Drawing Sheets

KEY STRUCTURE WITH DISPLAY MODULE

BACKGROUND OF THE INVENTION

(a) Field of the Invention

The present invention relates to a key structure, and more particularly to a key structure with display module.

(b) Description of the Prior Art

In general, the majority of commonly seen push-buttons with display function have application in machine equipment, or on transportation equipment or precision equipment that needs to validate whether or not the button has been pressed. However, the majority of structures of existing push-buttons can be divided into two types: the first type connects a display module portion to a circuit board using a cable arrangement configuration that serves as a signal transmission mode. Nevertheless, because of the cable arrangement relationship, such a method leads to a relatively short serviceable life, and assembly thereof is relatively difficult. As for the second type, fixed-type pins are used to connect upper and lower circuit boards, therefore, after the pins are used to connect the upper and lower circuit boards, the distance between each of the circuit boards is fixed and thus cannot be changed. Hence, prior to pressing a press cover, there is a relatively far distance between the display module and a transparent surface of the press cover, thus, images displayed by the display module cannot be seen at certain angles. And after pressing down on the press cover, the distance between the display module and the transparent surface of the press cover is shortened, and the images displayed by the display module are relatively clearly seen. However, at this time, there is the possibility of the images being distorted or indistinct because of problems of the press cover itself.

Apart from the aforementioned problems, the display module and a control switch use a single-point method as the connection means, thus leading to unsteadiness when pressing the press cover, that is, the single-point contact of the display module with the control switch only has a single supporting force. Under circumstances whereby the press cover is subjected to an uneven pressing force, the press cover will deviate to one side, which very easily results in imprecise pressing, and brings about unstable signal transmission that further leads to the inability to display the signal on the display module.

In the following embodiments, a detailed description of the characteristics and advantages of the present invention are given, the content of which is sufficient for any persons skilled in the art to understand the technical content and provide enablement thereof. Moreover, from the content disclosed in the specification, claims, and drawings, any persons skilled in the art can easily understand related objects and advantages of the present invention.

SUMMARY OF THE INVENTION

The main object of the present invention lies in clasping a base plate to a press cover, and to enable not only complete pressing down of the press cover through the use of flexible terminals but also enable concurrent up and down movement of the base plate and the press cover through use of each of the flexible terminals. In addition, the base plate and the press cover enable fixing the display module, as well as retaining a distance from the display module to the top surface of the press cover, thereby enabling the display module 11 to maintain displaying clear images, as well as increasing the display range.

In order to achieve the aforementioned object, a key structure with display module of the present invention comprises: a press cover, which defines a holding space; a display module, which is provided with a circuit structure and installed in the holding space; a base plate, which is installed to the press cover and restricts the display module, and is also fixed in the holding space; a control switch, which is electrically connected to a circuit board and fixed to the base plate; and a plurality of flexible terminals, each of which is electrically connected between the circuit structure and the circuit board.

According to an embodiment of the present invention, each of the flexible terminals comprises a first conductive member mounted on the circuit board, a flexible member disposed on one end of the first conductive member, and a second conductive member that is mounted on the circuit structure and abuts against the flexible member.

According to the embodiment of the present invention, the first conductive member defines a holding space for holding the flexible member.

According to the embodiment of the present invention, two corresponding sides of the base plate are respectively provided with a clasp portion which clasp onto the press cover, and the two other corresponding sides respectively define a make-way portion which enable the flexible terminals to penetrate and electrically connect to the circuit structure.

According to the embodiment of the present invention, the press cover is provided with corresponding clasps, which correspondingly clasp and are fixed to the clasp portions.

According to the embodiment of the present invention, a press space is formed in the structure of each of the clasp portions of the base plate.

According to the embodiment of the present invention, a surface of the base plate facing the control switch is provided with at least one fixing member that is fixed to the control switch.

According to the embodiment of the present invention, the control switch is provided with fixing holes for fixing the fixing members therein.

According to the embodiment of the present invention, the display module is a matrix of LEDs (light-emitting diodes) or LCDs (liquid crystal displays).

According to the embodiment of the present invention, the flexible terminals are pogo pins or springs.

According to the embodiment of the present invention, the control switch can be a rubber switch.

According to another embodiment of the present invention, the key structure with display module further comprises a base, and a plurality of connecting terminals are mounted on the base to enable electrical contact with the circuit board.

Another essential object of the present invention lies in enabling, through joining of the base plate and the key cover and assembly to the control switch, a uniform and stable pressing force that produces a reliable height of the press cover when pushing down thereon.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

The following uses concrete embodiments to describe the enabled configurations of the present invention, and from the content disclosed in the present specification, persons familiar with the art will easily understand other advantages and effects of the present invention.

It should be noted that the structures, proportions, and sizes depicted in the attached drawings are intended to illustrate and accompany the disclosure of this specification and to facilitate understanding for those with ordinary skills in the art, they in no way limit the present invention, and have no substantial meanings. Any structural modifications, proportional changes, or size adjustments that do not impact the effectiveness produced by the present invention and the objects the present invention can achieve should still equally fall within the range of the contents covered by the art disclosed in the present invention. Furthermore, wording cited in the present specification, such as "one", "two", and "upper", are only for the convenience of clarity in the description, and are not used to limit the scope of enablement of the present invention. Changes or adjustments in corresponding relationships under non-substantial alteration of the technology content are regarded as within the scope of enablement of the present invention.

Figure 1:
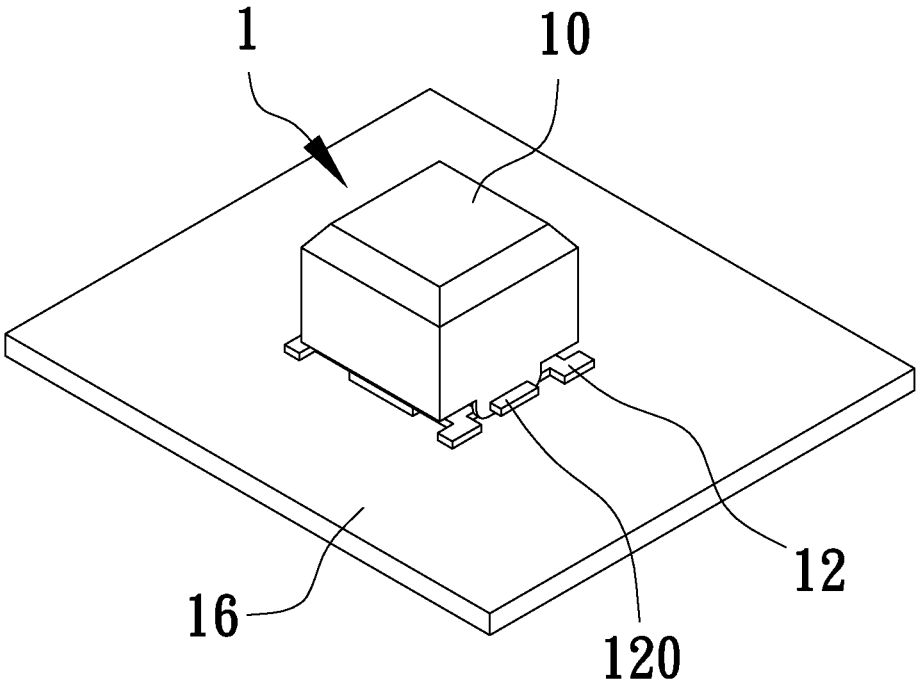
FIG. 1 is a three-dimensional structural schematic view of a preferred embodiment of the present invention.
Figure 2:
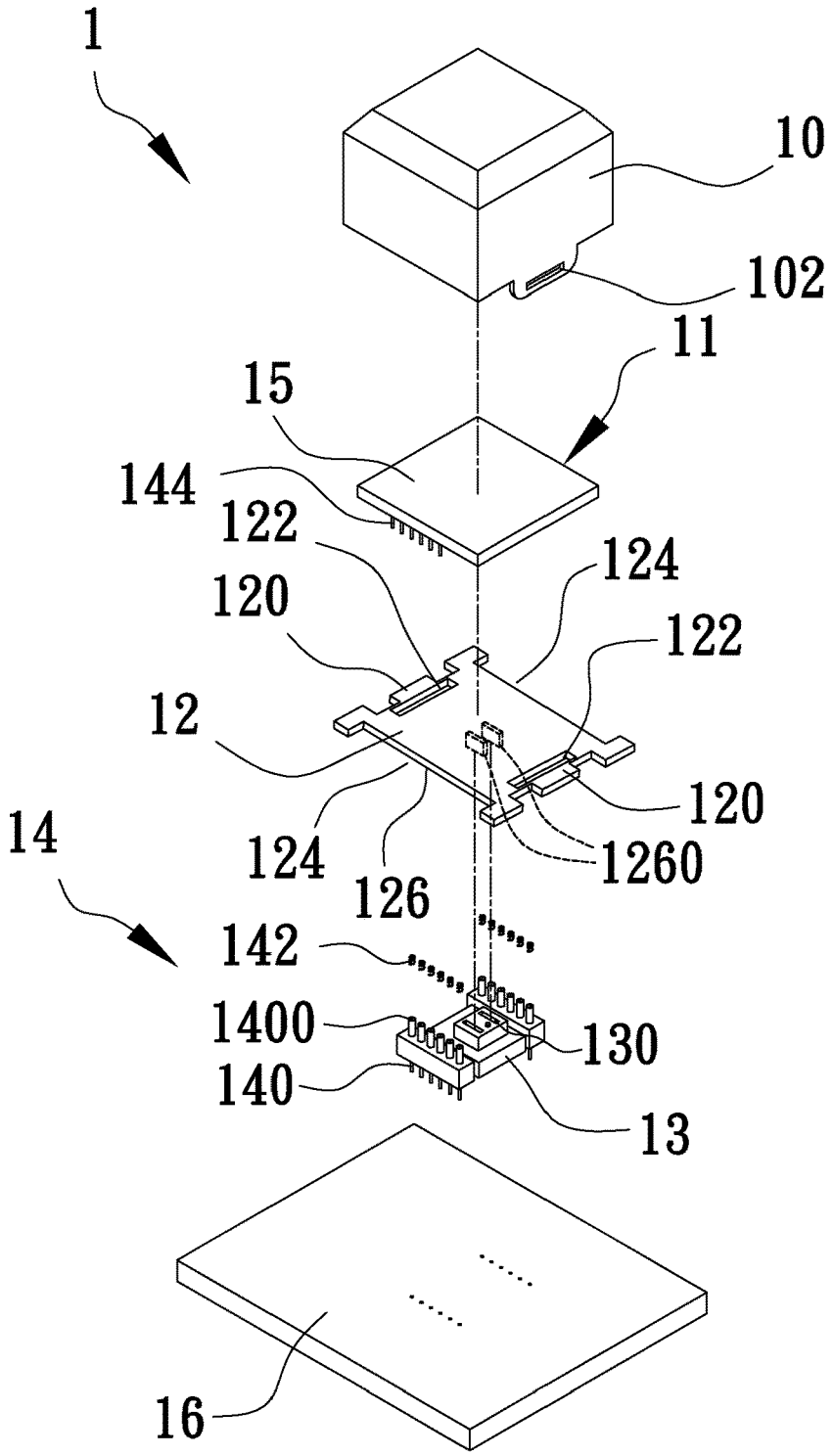
FIG. 2 is a three-dimensional exploded structural schematic view of the preferred embodiment of the present invention.
Figure 3:
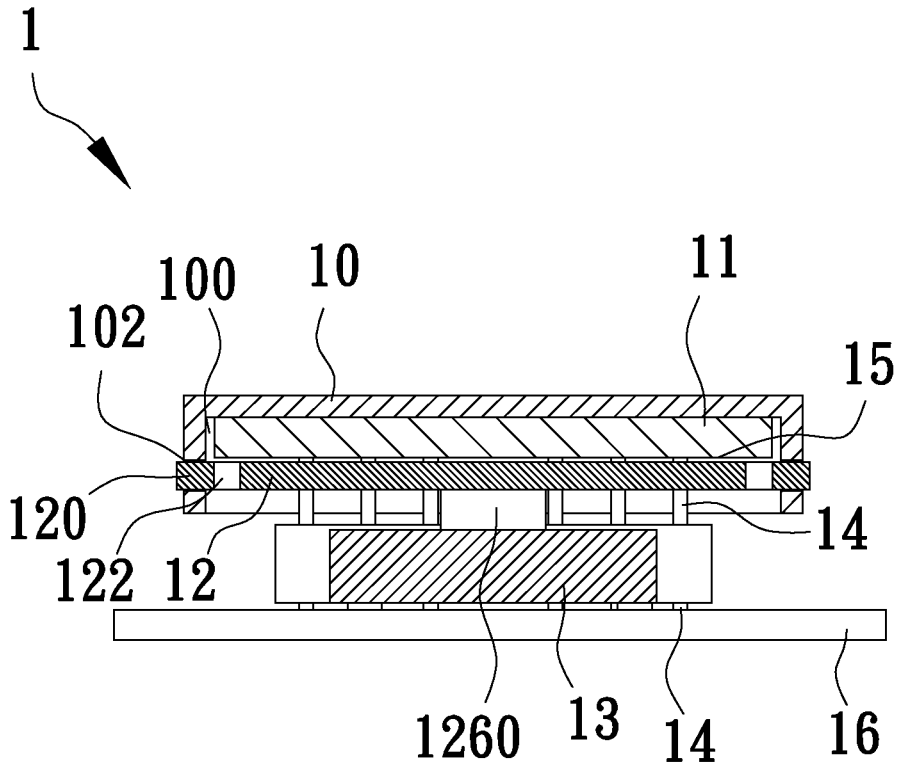
FIG. 3 is a cross-sectional structural schematic view of the preferred embodiment of the present invention.

Referring to FIG. 1, FIG. 2, and FIG. 3, which show a three-dimensional structural schematic view, a three-dimensional exploded structural schematic view, and a cross-sectional structural schematic view, respectively, of a preferred embodiment of the present invention, wherein the drawings depict a key structure with a display module, with a key structure 1 primarily comprising a press cover 10, a display module 11, a base plate 12, a control switch 13 (which can be a rubber switch), and flexible terminals 14. The display module 11 (can be a matrix of LEDs (light-emitting diodes) or LCDs (liquid crystal displays)) comprises a circuit structure 15, which is installed in a holding space 100 of the press cover 10. The base plate 12 is fitted on the press cover 10 and restricts the display module 11; moreover, the base plate 12 is fixed in the holding space 100. The control switch 13 is electrically connected to a circuit board 16 and fixed to the base plate 12. The flexible terminals 14 provide for an electrical connection between the circuit structure 15 and the circuit board 16, wherein each of the flexible terminals 14 comprises a first conductive member 140, a flexible member 142, and a second conductive member 144. The first conductive members 140 are mounted on the circuit board 16, and each of the conductive members 140 defines an installation space 1400 to contain the respective flexible member 142. The second conductive members 144, which are mounted on the circuit structure 15, respectively abut against the flexible members 142 when in use, thereby enabling a change in the distance between the circuit structure 15 and the circuit board 16 to be produced through compression of the flexible terminals 14.

In the aforementioned description, a clasp portion 120 is disposed positioned on each of two corresponding sides of the base plate 12, and corresponding clasps 102 are provided on the press cover 10. Accordingly, the clasp portions 120 on the base plate 12 are able to mutually fasten with the corresponding clasps 102 on the press cover 10. And because the clasp portions 120 are disposed at corresponding positions on the base plate 12, thus, during assembly, the clasp portions 120 are necessarily fixed to the respective corresponding clasps 102 on the two corresponding positions of the press cover 10. Hence, when applying force to the press cover 10, even if the force is uneven, the base plate 12 achieves the effectiveness of stabilizing the pressing force to stop the press cover 10 from tilting. In addition, a press space 122 is formed in the structure of each of the clasp portions 120 to allow the clasp portions 120 to easily clasp onto the corresponding clasps 102. Hence, the press spaces 122 provide the clasp portions 120 with sufficient expanding/contracting space when pressed. Moreover, after assembling of the base plate 12 to the press cover 10, the display module 11 is confined to within the holding space 100 of the press cover 10. More importantly, the display module 11 is held tightly to the internal surface of the press cover 10, and thus follows along closely with the up and down displacement of the press cover 10, affecting concurrent movement in position therewith.

Furthermore, make-way portions 124 are respectively defined in the other two corresponding sides of the base plate 12. The make-way portions 124 primarily enable soldering of the flexible terminals 14 modules between the circuit structure 15 and the circuit board 16. In addition, a surface 126 of the base plate 12 facing the control switch 13 is provided with at least one fixing member 1260, and the control switch 13 is also provided with corresponding fixing holes 130 to enable fixing the fixing members 1260 therein, thereby achieving the effect of a structural spacing between the base plate 12 and the control switch 13.

Figure 4:
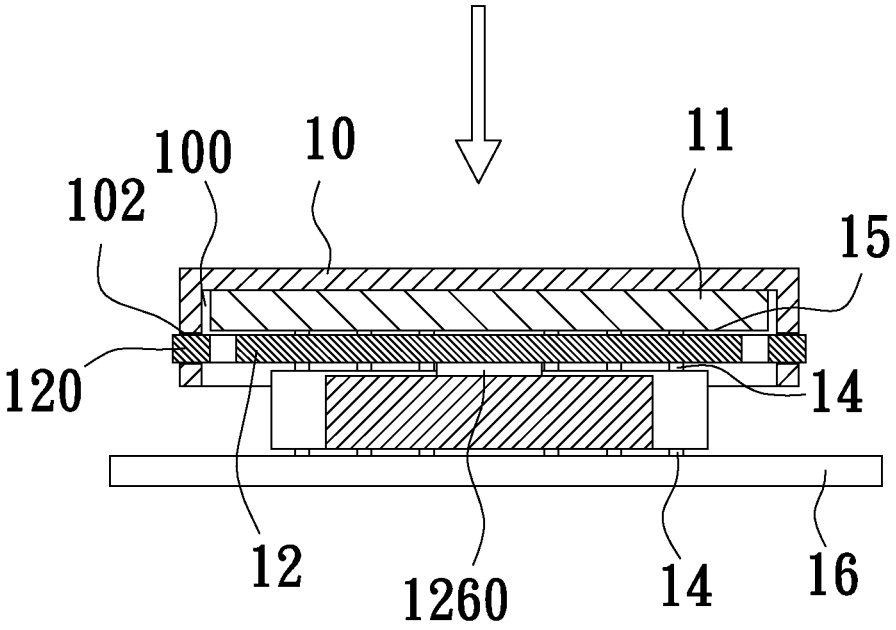
FIG. 4 is a cross-sectional structural schematic view depicting an operating state of the preferred embodiment of the present invention.
Figure 5:
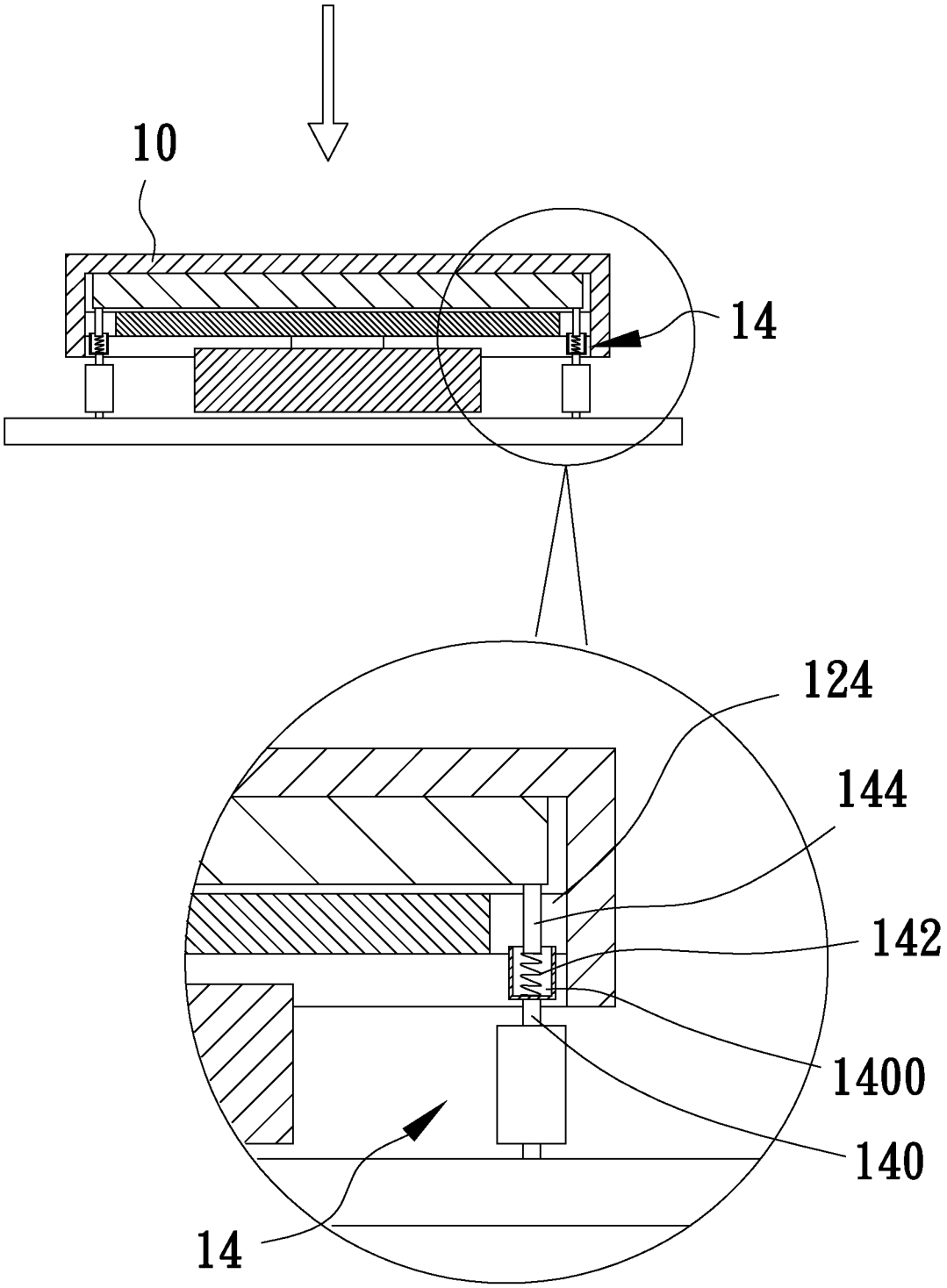
FIG. 5 is a partially enlarged cross-sectional structural schematic view of the present invention using pogo pins as flexible terminals.

Referring to FIG. 4 and FIG. 5, which respectively show a cross-sectional structural schematic view depicting an operating state of the preferred embodiment of the present invention and a partially enlarged cross-sectional structural schematic view of the present invention using pogo pins as the flexible terminals 14, wherein in order to enable stable displacement of the press cover 10 and enable concurrent up and down movement of the base plate 12 and the press cover 10 through use of each of the flexible terminals 14 to allow the display module 11 to maintain displaying clear images and increase the display range, assembly of the embodiment of the present invention mainly involves first using the clasp portions 120 disposed on two corresponding sides of the base plate 12 to respectively clasp into the corresponding clasps 102 on the corresponding sides of the press cover 10, after which the electrically connected display module 11 is thereby fixedly restricted within the holding space 100 of the press cover 10. Furthermore, the flexible terminals 14 (which can be pogo pins or springs) connected between the circuit structure 15 and the circuit board 16 enable changing the distance therebetween. More specifically, when pressing down on the press cover 10, the press cover 10 along with the base plate 12 and the display module 11 inside the press cover 10 will concurrently displace downward; moreover, the height position displacement of the display module 11 is changed by means of the flexible terminals 14. Hence, the changing height position of the flexible terminals 14 is primarily caused from the display module 11 being displaced downward because of downward pressure on the press cover 10, which causes downward movement of the flexible terminals 14, thereby concurrently driving the first conductive members 140 and compressing the flexible members 142 inside the holding spaces 1400. Accordingly, compression of the flexible terminals 14 produces a change in the distance between the circuit structure 15 and the circuit board 16. Therefore, when a user presses down on the entire key structure 1, not only is an uniform and stable force produced that enables effecting a dependable change in height position, more importantly, the base plate 12 and the press cover 10 enable fixing the display module 11 while retaining a distance to the top surface of the press cover 10 allowing for the display of clear images on the display module 11, as well as increasing the display range.

Figure 5A:
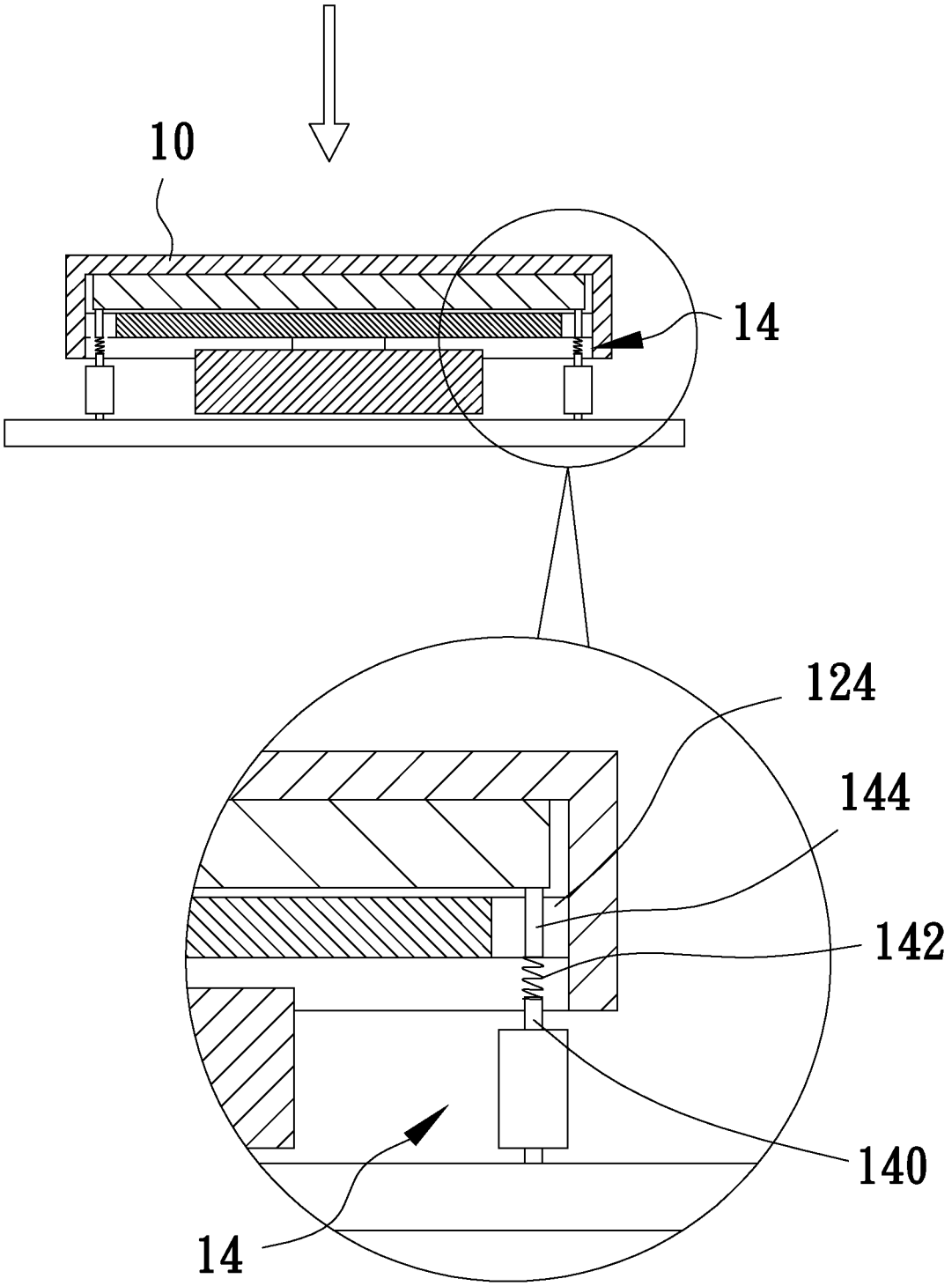
FIG. 5A is a partially enlarged cross-sectional structural schematic view of the present invention using springs as flexible terminals.
Figure 6:
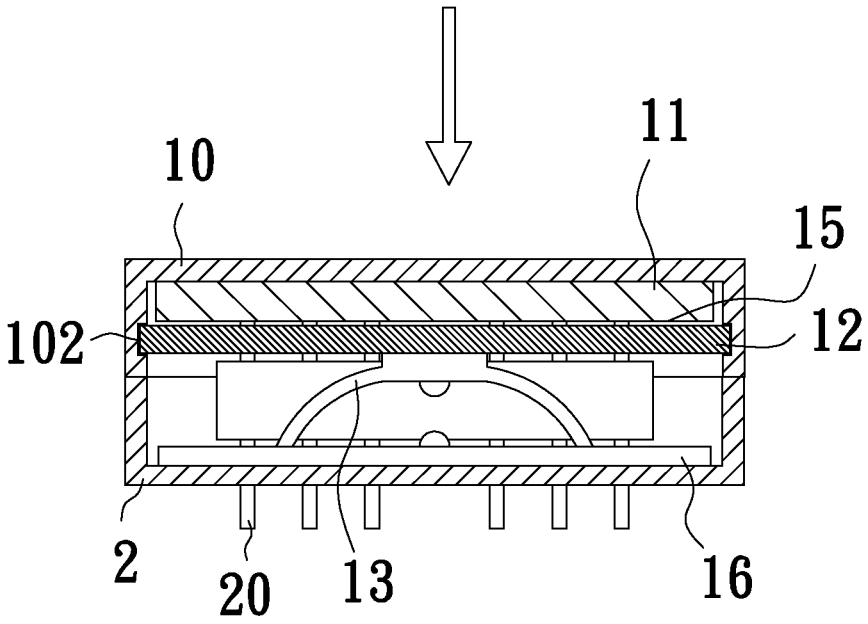
FIG. 6 is a cross-sectional structural schematic view of another preferred embodiment of the present invention.
Figure 7:
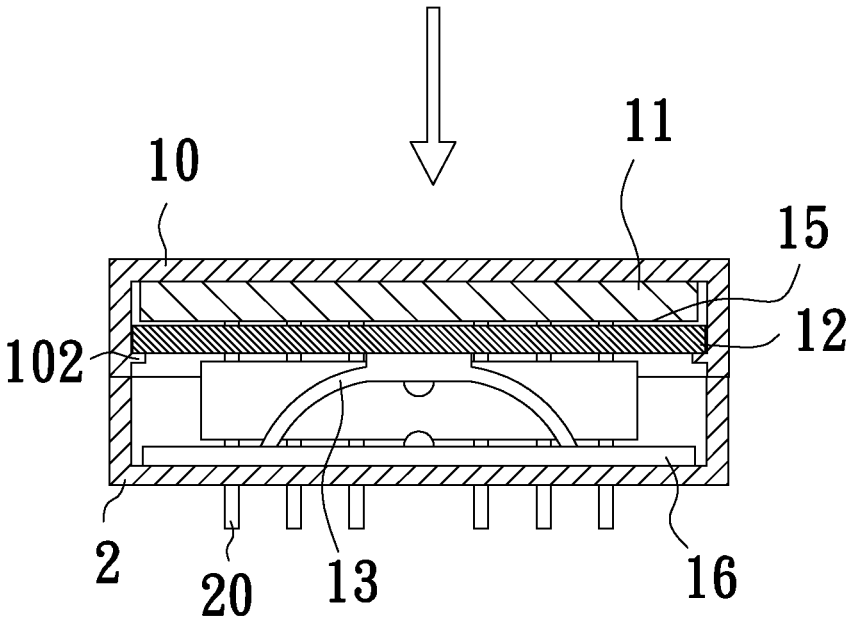
FIG. 7 is a cross-sectional structural schematic view of yet another preferred embodiment of the present invention.

Apart from the above described structure, referring to FIG. 5A, FIG. 6, and FIG. 7, which show a partially enlarged cross-sectional structural schematic view of the flexible terminals 14, a cross-sectional structural schematic view of another preferred embodiment, and a cross-sectional structural schematic view, respectively, of the present invention, wherein FIG. 6 shows the corresponding clasps 102 of the press cover 10 sunk in the inner walls of the press cover 10. In FIG. 5A, the flexible terminals 14 adopt a spring means as the primary compression configuration, which mainly comprises the first conductive members 140 mounted on the circuit board 16, with the second conductive members 144 mounted on the circuit structure 15. The flexible members 142 (that is, springs) are respectively directly installed between the first conductive members 140 and the second conductive members 144. Accordingly, a change in the distance between the circuit structure 15 and the circuit board 16 is produced through compression of the flexible terminals 14. In addition, the control switch 13 primarily adopts a rubber switch, and the elastic behavior of the rubber itself is used to achieve a switching function after pressing down thereon. Moreover, a base 2 is installed on the bottom portion of the circuit board 16, and connecting terminals 20 are additionally mounted on the base 2. Hence, joining of the circuit board 16 and the base 2 enables the key structure 1 of the present invention to become the independent single key structure 1. In FIG. 7, the corresponding clasps 102 inside the press cover 10 adopt a protruding means to extend out from the inner wall of the press cover 10, which enable installing and fixing to the base 2. Other structural portions are the same as FIG. 5A and FIG. 6, and thus not further detailed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A key structure with display module, comprising:

a press cover, which defines a holding space;

a display module, which is provided with a circuit structure and installed in the holding space;

a base plate, which is installed to the press cover and restricts the display module, and is also fixed to the holding space;

a control switch, which is electrically connected to a circuit board and fixed to the base plate; and a plurality of flexible terminals, each of which is electrically connected between the circuit structure and the circuit board;

wherein a distance between the circuit structure and the circuit board is changed through compression of the flexible terminals;

wherein two corresponding sides of the base plate are respectively provided with a clasp portion which clasp to the press cover, and the two other corresponding sides respectively define a make-way portion which enable the flexible terminals to penetrate and electrically connect to the circuit structure.

2. The key structure with display module according to claim 1, wherein each of the flexible terminals comprises a first conductive member mounted on the circuit board, a flexible member disposed on one end of the first conductive member, and a second conductive member that is mounted on the circuit structure and abuts against the flexible member.

3. The key structure with display module according to claim 2, wherein each of the first conductive members defines a holding space for holding the flexible member therein.

4. The key structure with display module according to claim 1, wherein the press cover is provided with corresponding clasps that correspondingly connect and fix to the clasp portions.

5. The key structure with display module according to claim 1, wherein a press space is formed in a structure of each of the clasp portions of the base plate.

6. The key structure with display module according to claim 1, wherein a surface of the base plate facing the control switch is provided with at least one fixing member that is fixed to the control switch.

7. The key structure with display module according to claim 6, wherein the control switch is provided with fixing holes to enable fixing the fixing members therein.

8. The key structure with display module according to claim 1, wherein the display module is a matrix of LEDs (light-emitting diodes) or LCDs (liquid crystal displays).

9. The key structure with display module according to claim 1, wherein the flexible terminals are pogo pins or springs.

10. The key structure with display module according to claim 1, wherein the control switch is a rubber switch.

11. The key structure with display module according to claim 1, further comprises a base, and a plurality of connecting terminals are mounted on the base to enable electrical contact with the circuit board.

* * * * *